United States Patent [19]

Lucero et al.

[11] Patent Number: 4,913,201

[45] Date of Patent: Apr. 3, 1990

[54] LIQUID FUEL FUNNEL

[76] Inventors: Ronald C. Lucero, 336 W. Andrix St., Monterey Park, Calif. 91754; Nick V. Agnoletto, 5763 Amethyst St., Alta Loma, Calif. 91701

[21] Appl. No.: 297,013

[22] Filed: Jan. 17, 1989

[51] Int. Cl.[4] ..... B67C 11/00

[52] U.S. Cl. ..... 141/334; 141/339; 141/340; 141/341; 141/98

[58] Field of Search ..... 141/297–300, 141/310, 331–345, 98, 282, 387

[56] References Cited

U.S. PATENT DOCUMENTS

| | | | |
|---|---|---|---|
| 582,652 | 5/1897 | Larson | 193/2 R |
| 1,337,558 | 4/1920 | King | 141/330 |
| 2,083,663 | 6/1937 | Pearson | 141/310 |
| 2,116,979 | 5/1978 | Moller | 141/334 X |
| 2,260,430 | 10/1941 | Blasingame | 141/334 |
| 2,620,957 | 12/1952 | Taylor | 141/334 |
| 2,739,464 | 3/1956 | Smith | 141/334 X |
| 3,986,538 | 10/1976 | Sather | 141/332 |
| 4,130,147 | 12/1978 | Langlie et al. | 141/98 |
| 4,143,690 | 3/1979 | Dunicz | 141/333 |
| 4,338,983 | 7/1982 | Hatcher | 141/331 |
| 4,347,878 | 9/1982 | Schofield | 141/300 |
| 4,600,125 | 7/1986 | Maynard, Jr. | 141/331 X |
| 4,789,017 | 12/1988 | Panasewicz et al. | 141/342 |

FOREIGN PATENT DOCUMENTS

| | | | |
|---|---|---|---|
| 805846 | 5/1951 | Fed. Rep. of Germany | 141/310 |

*Primary Examiner*—Ernest G. Cusick

*Attorney, Agent, or Firm*—John J. Posta, Jr.

[57] ABSTRACT

The liquid fuel funnel features a no-drip configuration which includes an elongated generally horizontal fuel-receiving rear portion with an open top, which may bear a closeable lid, and a front, fuel-dispensing, spout portion which is preferably oval in transverse cross-section and which curves and tapers downwardly and forwardly to an open exit end which may bear a removable plug. That end may be generally vertical or at an angle thereto. The funnel can include one or more detents for releasably holding the funnel in a proper pouring position with the spout portion within and against a fuel container opening such as a vehicle gasoline tank opening. The detents can be on the bottom and top of the spout portion. The top detent can be on a long angled leaf spring or the like connected to and extending about the top of the spout portion. The funnel is preferably of metal and can be made economically of one-piece durable construction.

2 Claims, 2 Drawing Sheets

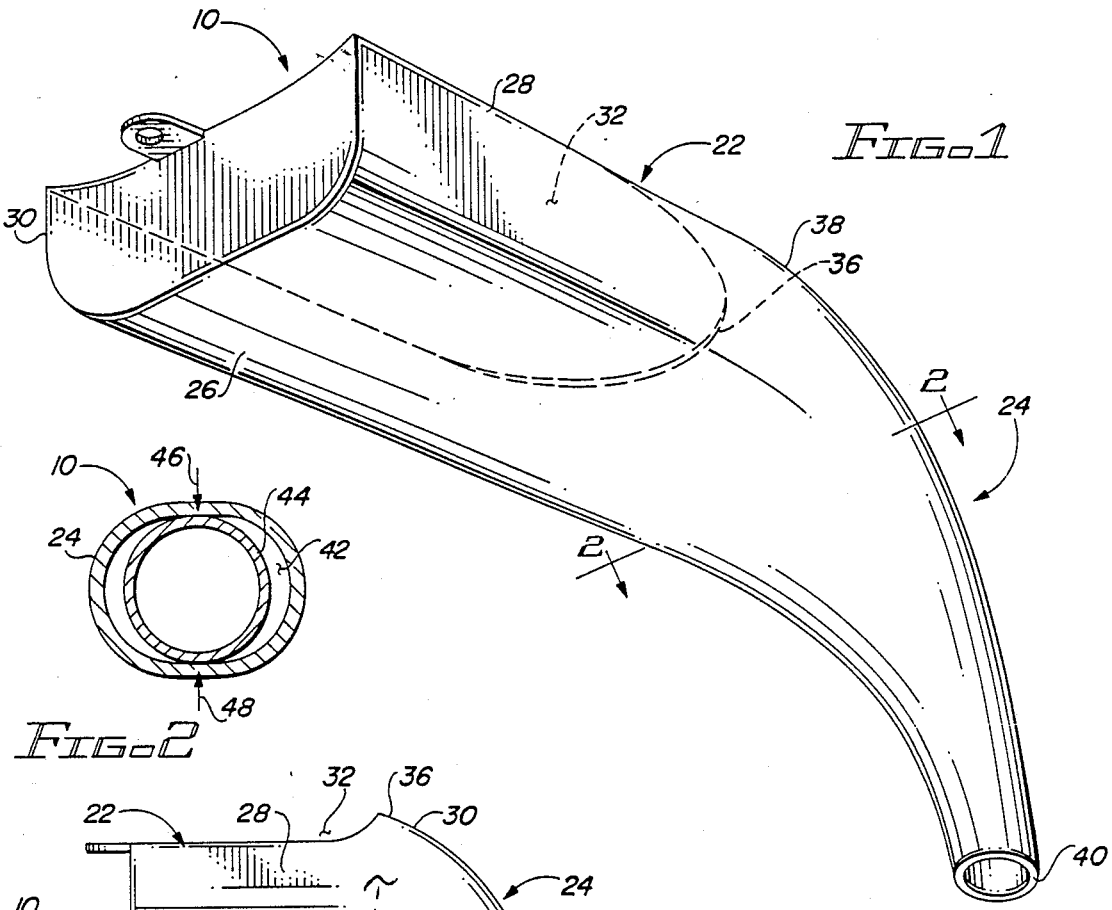
FIG. 1
FIG. 2
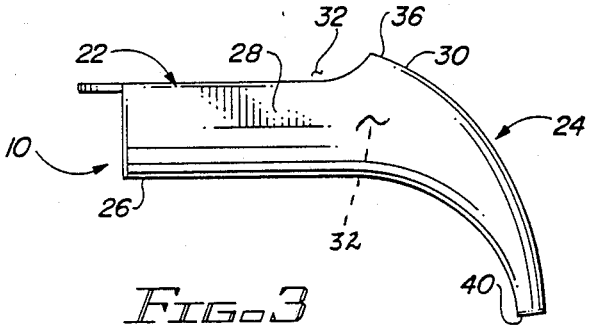
FIG. 3
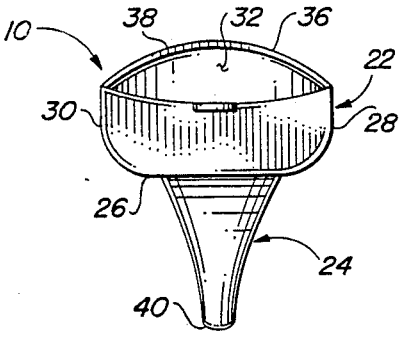
FIG. 4
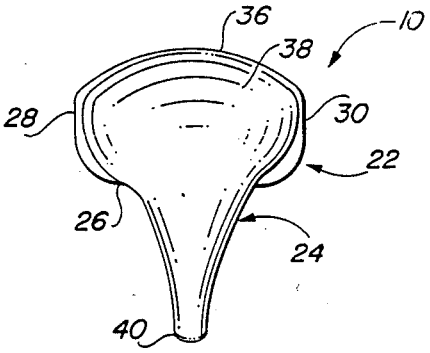
FIG. 5

LIQUID FUEL FUNNEL

BACKGROUND OF THE INVENTION

1. FIELD OF THE INVENTION

The present invention generally relates to fuel transfer means and more particularly to a liquid fuel non-spill funnel of an improved unitary type.

2. PRIOR ART

Various types of funnels have been devised for transferring liquid fuel from one container to another. See, for example, U.S. Pat. Nos. 1,337,558 wherein a V-shaped tray is used to hold a gasoline can after it is pierced by the rear end of a delivery nozzle attached to the tray. See also U.S. Pat. Nos. 582,652, 2,620,957 and 4,130,147 which discloses 2-piece devices with round topped upper funnels and detachable bottom cylindrical nozzles directly under the funnels. One piece round topped funnels with integral depending nozzles are shown in U.S. Pat. Nos. 2,260,430; 4,143,690 and 4,347,878.

There remains a need for an improved funnel which will avoid spillage in an improved manner, which will trap the nozzle of a gasoline can and support the gasoline can while the funnel itself is supported in position, and which will be readily insertable and supported in container openings of various sizes. Preferably, the funnel should also be capable of temporarily retaining liquid fuel therein for inspection, etc., until released from the nozzle. The funnel should be light weight, durable, inexpensive and efficient.

SUMMARY OF THE INVENTION

The improved funnel of the present invention satisfies all the foregoing needs. Thus, the funnel can be of one piece construction, is light in weight, inexpensive, durable and efficient. The open-topped, fuel-receiving rear portion of the funnel is horizontal and elongated and the integral nozzle is oval and extends forwardly thereof, gradually tapering and curving down to its open front end, so that it can readily trap a gasoline or oil can nozzle in its rear end for spill-free fuel pouring, yet allow air to escape through the gaps between the oval funnel nozzle and the round can nozzle to avoid fuel splashing and spillage.

Moreover, the tapered front of the funnel nozzle will fit into various sizes of fuel container openings. Preferably, the funnel nozzle bears spaced detents to releasably support the funnel in the operative position against a container to be filled with fuel.

The rear fuel-receiving top of the funnel may have an openable lid, and a removable plug may be provided to seal the open front end of the nozzle when, for example, it is desired to hold and inspect a liquid fuel in the funnel before allowing it to pass out of the funnel.

Various other advantages of the present invention are set forth in the following detailed description and accompanying drawings.

DRAWINGS

FIG. 1 is a schematic bottom-side perspective view, partly broken away, of a first preferred embodiment of the improved unitary non-spill funnel of the present invention;

FIG. 2 is a schematic cross-section of the funnel of FIG. 1 around a gasoline can nozzle, taken along the section line 2—2 of FIG. 1;

FIG. 3 is a reduced size schematic side elevation of the funnel of FIG. 1;

FIG. 4 is a schematic reduced size rear elevation of the funnel of FIG. 1;

FIG. 5 is a schematic reduced size front elevation of the funnel of FIG. 1;

DETAILED DESCRIPTION

FIGS. 1-5

Figure 6:
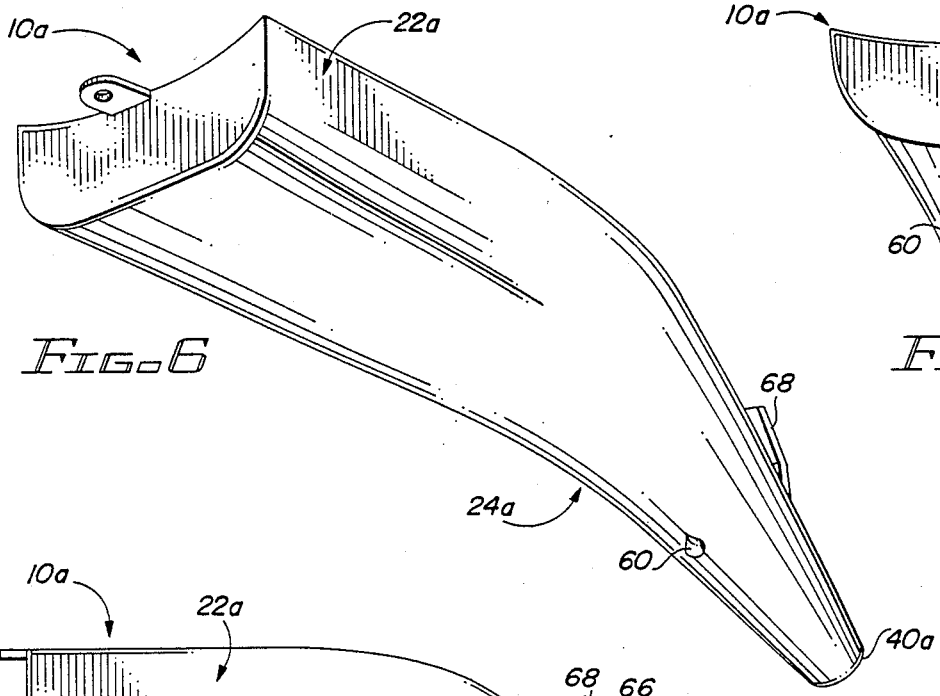
FIG. 6 is a schematic bottom-side perspective view of a second preferred embodiment of the improved unitary non-spill funnel of the present invention.
Figure 8:
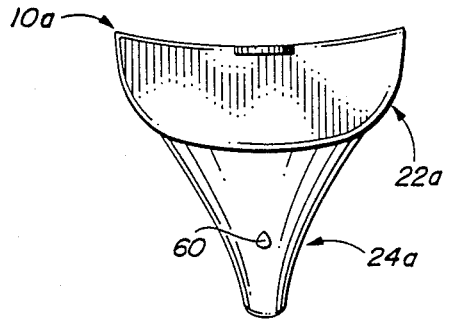
FIG. 8 is a schematic rear elevation, partly broken away, of the funnel of FIG. 6.
Figure 7:
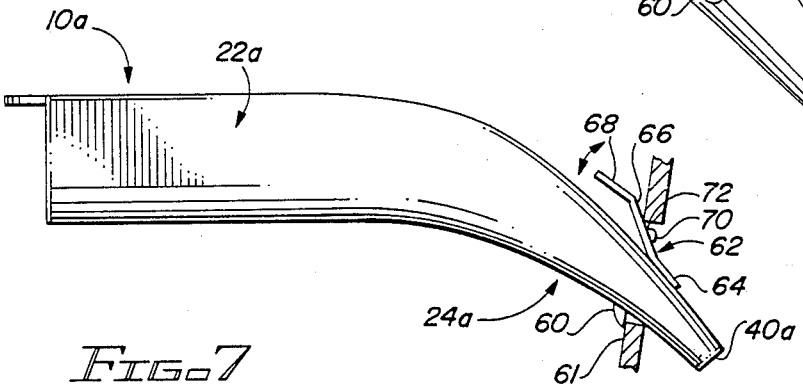
FIG. 7 is a schematic fragmentary side elevation of the funnel of FIG. 6.
Figure 9:
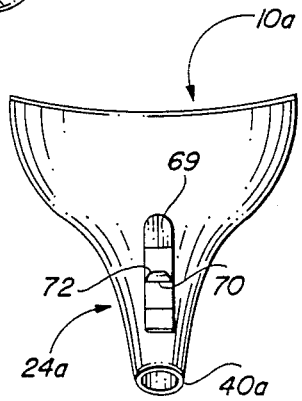
FIG. 9 is a schematic front elevation of the funnel of FIG. 6.

Now referring more particularly to FIGS. 1-5 of the drawings, a first preferred embodiment of the improved non-drip unitary funnel of the present invention is schematically shown therein. Thus, funnel 10 is shown, which comprises a rear, liquid fuel-receiving portion 22 integrally connected to a front, liquid fuel-delivering nozzle or spout portion 24.

Portion 22 includes a generally flat horizontal bottom 26, integrally connected to upraised generally vertical spaced side walls 28 & 30 collectively defining therewith an open top 32 and central liquid fuel-receiving space 34. Portion 22 is generally rectangular in transverse cross section and is elongated longitudinally, extending horizontally, with open top 32 long and wide in order to easily receive liquid fuel from a dispensing can (not shown) or the like without spillage. Portion 22 tapers to a narrower front end 36 thereof where it joins integral spout portion 24.

Spout portion 24 tapers, that is, narrows from its rear end 38 to its front end 40 and curves downwardly, as shown in FIGS. 1 & 3 from an about horizontal position at rear end 38, to an about vertical position at front end 40. Portion 24 has a central cavity 42 extending longitudinally therethrough from end 38 to end 40. Cavity 42 communicates with space 34. Portion 24 is oval in transverse cross-section (FIGS. 1 & 2) as is cavity 42, so that, for example, a cylindrical nozzle 44 of a gasoline depending can or the like (not shown) can be inserted through top 32 and space 34 into the rear of cavity 42 (FIG. 2) and will lodge therein, e.g., at points 46 & 48, without blocking the free passage of air in cavity 42 and the free flow of fuel therethrough. Therefore, there is no bubbling or gushing, splashing, spattering or blockage of liquid fuel as it is poured through nozzle 44 into cavity 42 and out end 40.

Funnel 10 and space 34 can be made sufficiently large so that a gasoline can can rest in space 34, with nozzle 44 in the position indicated in FIG. 2. Moreover, end 40 can be inserted into an opening (not shown) in a liquid fuel container (not shown) such as a vehicle gasoline tank or an oil or gasoline drum or the like and will hold funnel upright, with portion 22 horizontal for easy transfer of liquid fuel through funnel 10.

Funnel 10 can be made in one piece of metal, such as aluminum, steel, etc., or non-reactive durable plastic or hardened rubber or the like suitable material, in any desired size. For example, funnel 10 can be about 31 cm. long, about 11 cm. wide at its rear, about 8 cm. wide at its end 38 and about 2 cm. wide at its end 40. Other dimensions are also suitable.

Funnel 10 provides improved ease of transfer of liquid fuel therethrough without spillage and with funnel 10 automatically held in the desired position with portion 22 thereof horizontal.

FIGS. 6–10

A second preferred embodiment of the improved funnel of the present invention is schematically depicted in FIGS. 6–10, inclusive. Thus, funnel 10*a* is shown. Components thereof similar to those of funnel 10 bear the same numerals, but are succeeded by the letter "a".

Funnel 10*a* is substantially identical to funnel 10, except as follows:

(a) spout portion 24*a* and end 40*a* thereof of funnel 10*a* (see FIG. 7) are at a shallower angle to portion 22*a* than the about vertical position of end 40 in funnel 10; and, (b) spout portion 24*a* includes detent means for releasably holding spout portion 24*a* in and/or against an opening in a liquid fuel container or tank; such means comprises a bottom, generally triangular depending ledge or stud 60 adapted to abut against the outside of a container opening lip 61 (FIG. 7), and a leaf spring 62, the front end 64 of which is connected to the upper surface of portion 24*a* and the middle portion 66 of which rises rearwardly about portion 24*a* and terminates in an angled rear end 68. Spring middle portion 66 bears a ledge or button 70 on the upper surface thereof, the rear end 72 of which button 70 acts as a releasable locking barrier to releasably hold end 40*a* inside lip 61 of a fuel container or tank (not shown) for spill-free pouring of fuel through funnel 10*a*. Flexing of end 68 down towards the adjacent upper surface of portion 34*a* (FIG. 7) releases end 40*a* from lip 61. Accordingly, funnel 10*a* has the advantages of funnel 10, plus the releasable locking feature discused above.

FIG. 11

Figure 11:
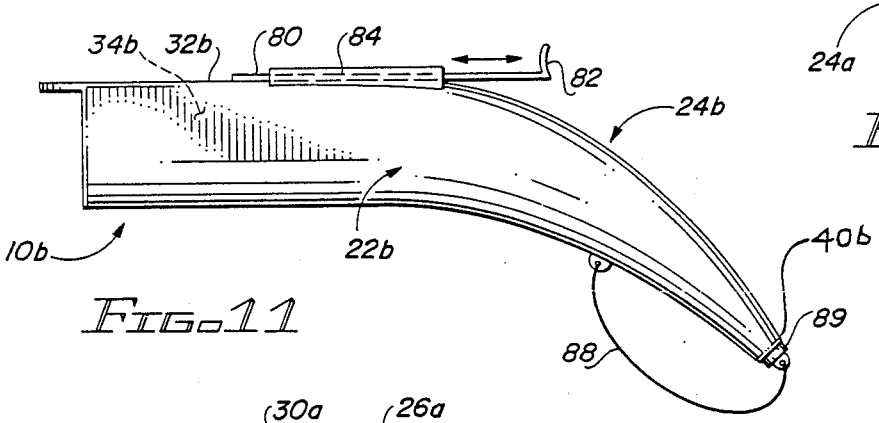
FIG. 11 is a reduced size schematic side elevation, partly broken away, of a third preferred embodiment of the improved unitary non-drip funnel of the present invention.
Figure 10:
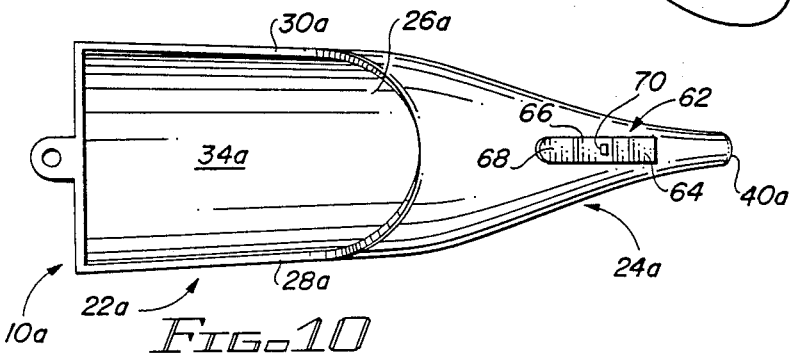
FIG. 10 is a schematic top plan view of the funnel of FIG. 6.

A third preferred embodiment of the improved funnel of the present invention is schematically depicted in FIG. 11 in side elevation. Thus, funnel 10*b* is shown. Components thereof similar to those of funnel 10 bear the same numerals but are succeeded by the letter "b".

Funnel 10*b* differs from funnel 10 only as follows:

(a) top 32*b* and space 34*b* are releasably sealed by a horizontal slidable lid 80 bearing a front pull lip 82, lid 80 being slidably disposed in a pair of horizontal rails 84 connected to the upper ends of the sides of portion 22*b*; and, (b) front end 40*b* is releasably sealed by a removable plug 89 connected by a chain 89 to the outer surface of nozzle portion 24*b*.

Lid 80 and plug 89 permit funnel 10*b* to be temporarily sealed off in order, for example, to, at a later time, inspect fuel therein for sediment, contaminants, etc. Lid 80 and plug 89 also prevent fuel fumes and liquid from escaping from funnel 10*b* after it has been used to transfer such fuel.

Funnel 10*b* has the advantages of funnel 10, plus the sealability feature referred to above.

Various other modifications, changes, alterations and additions can be made in the improved funnel of the present invention, its components and their parameters. All such modifications, changes, alterations and additions as are within the scope of the appended claims form part of the present invention.

What is claimed is:

1. An improved non-drip, unitary liquid fuel funnel, said funnel comprising an elongated, integral, one piece body having:

(a) a rear fuel-receiving generally horizontal portion having an open top and interconnected closed sides, a real wall and bottom defining a central fuel-receiving space from end to end thereof; and, (b) a front, fuel-dispensing closed, generally tubular spout portion having an open front end portion integrally connected to said fuel-receiving portion and curving and tapering downwardly and forwardly from said fuel-receiving portion to an open front end portion, said spout portion having a central cavity extending from end to end thereof and communicating with said space and with said open front end of said funnel for dispensing fuel from said funnel, (c) wherein the exterior of said spout portion of said funnel bears means adapted for releasably securing said funnel against a lip of a fuel-receiving container, such as a vehicle gasoline tank, (d) wherein said releasable securing means comprises a bottom extension adapted to abut the bottom of said lip and a top flexible spring projecting rearwardly and at an acute angle upwardly from said spout portion and bearing a lip-abutting detent on the upper surface of said spring.

2. A funnel having a fuel-receiving portion to releasably retain a fluid container having a nozzle and having a substantially round cross-section, comprising an elongated, integral unitary body having, (a) a rear portion having side and rear walls adapted to releasably receive said fluid container therein, and (b) a front spout portion having an open front portion, (c) wherein a section of said body interconnecting said front to rear portion is oval in cross-section so as to releasably hold said container and pass fluid from said container through said nozzle while permitting air to pass from the interior of said front end to the exterior of said funnel, (d) wherein the exterior of said spout portion of said funnel bears means adapted for releasably securing said funnel against a lip of a fuel-receiving container, such as a vehicle gasoline tank, (e) wherein said releasable securing means comprises a bottom extension adapted to abut the bottom of said lip and a top flexible spring projecting rearwardly and at an acute angle upwardly from said spout portion and bearing a lip-abutting detent on the upper surface of said spring.

* * * * *